US009837720B2

(12) United States Patent
Ryu et al.

(10) Patent No.: US 9,837,720 B2
(45) Date of Patent: Dec. 5, 2017

(54) METAMATERIAL ANTENNA

(71) Applicant: EMW CO., LTD., Incheon (KR)

(72) Inventors: Byung Hoon Ryu, Seoul (KR); Won Mo Sung, Gyeonggi-do (KR); Jeong Pyo Kim, Seoul (KR)

(73) Assignee: EMW CO., LTD., Incheon (KR)

( * ) Notice: Subject to any disclaimer, the term of this patent is extended or adjusted under 35 U.S.C. 154(b) by 107 days.

(21) Appl. No.: 14/428,976

(22) PCT Filed: Sep. 17, 2012

(86) PCT No.: PCT/KR2012/007391
§ 371 (c)(1),
(2) Date: Mar. 17, 2015

(87) PCT Pub. No.: WO2014/042301
PCT Pub. Date: Mar. 20, 2014

(65) Prior Publication Data
US 2015/0249289 A1 Sep. 3, 2015

(51) Int. Cl.
*H01Q 9/04* (2006.01)
*H01Q 1/24* (2006.01)
*H01Q 15/00* (2006.01)

(52) U.S. Cl.
CPC ..... *H01Q 9/0442* (2013.01); *H01Q 1/243* (2013.01); *H01Q 15/0086* (2013.01)

(58) Field of Classification Search
CPC ... H01C 9/0442; H01C 15/0086; H01C 1/243
USPC ..... 343/702, 745, 749, 750
See application file for complete search history.

(56) References Cited

U.S. PATENT DOCUMENTS

| | | | | |
|---|---|---|---|---|
| 7,079,079 | B2 * | 7/2006 | Jo | H01Q 1/243 343/700 MS |
| 8,659,501 | B2 * | 2/2014 | Ryou | H01Q 15/0086 343/722 |
| 2011/0183633 | A1 * | 7/2011 | Ohba | H01Q 1/243 455/77 |
| 2012/0127049 | A1 * | 5/2012 | Kato | H01Q 1/243 343/749 |
| 2013/0201067 | A1 * | 8/2013 | Hu | H01Q 1/243 343/745 |

FOREIGN PATENT DOCUMENTS

| | | | |
|---|---|---|---|
| CN | 104641506 | A | 5/2015 |
| JP | 2011-166540 | A | 8/2011 |
| KR | 20-0377493 | Y1 | 3/2005 |
| KR | 10-2010-0110951 | A | 10/2010 |
| KR | 10-1074331 | B1 | 10/2011 |
| WO | 2014/042301 | A1 | 3/2014 |

OTHER PUBLICATIONS

International Search Report for PCT/KR2012/007391.

* cited by examiner

*Primary Examiner* — Dameon E Levi
*Assistant Examiner* — Hasan Islam
(74) *Attorney, Agent, or Firm* — The PL Law Group, PLLC

(57) ABSTRACT

Disclosed is a metamaterial antenna including a conductor cover formed at one side of a wireless terminal, a feed parallel inductor element formed to connect the conductor cover to a feed part, and at least one ground parallel inductor element formed to connect the conductor cover to at least one ground part.

2 Claims, 14 Drawing Sheets

METAMATERIAL ANTENNA

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/KR2013/004152, filed 10 May 2013, which claims priority to Korean Patent Application No. 10-2012-0096209, filed 31 Aug. 2012, the entire contents of which are incorporated herein by reference.

TECHNICAL FIELD

Embodiments of the present invention relate to a metamaterial antenna, and more particularly, to a metamaterial antenna using a conductor cover of a wireless terminal.

BACKGROUND PART ART

In recent years, wireless terminals, such as mobile phones, smart phones, and personal digital assistants (PDAs), has been developed with an emphasis on the appearance design as well as a variety of functions, such as a voice call, a Global Positioning System (GPS), Digital Multimedia Broadcasting (DMB), data communication, the Internet, authentication, payment, and near field communication. Thus, in order to provide a refined design, a conductor cover may be formed at an exterior of the wireless terminal (for example, at a lateral side of the wireless terminal). In this case, the radiation efficiency of an embedded antenna of the wireless terminal may be degraded due to the conductor cover. That is, since the conductor cover formed at an exterior of the wireless terminal serves as an obstacle restricting or hindering electric waves radiated from the embedded antenna, the radiation efficiency of the embedded antenna may be degraded. Accordingly, there is a need for a method for preventing the radiation efficiency of an embedded antenna from being degraded while maintaining a refined design when a conductor cover is formed at the exterior of a wireless terminal.

SUMMARY

The embodiments of the present invention provide a metamaterial antenna capable of preventing the radiation efficiency of an embedded antenna from being degraded even if a conductor cover is formed at the exterior of a wireless terminal.

According to an aspect of the present invention, there is provided a metamaterial antenna including a conductor cover, a feed parallel inductor element, and at least one ground parallel inductor. The conductor cover may be formed at one side of a wireless terminal. The feed parallel inductor element may be formed to connect the conductor cover to a feed part. The at least one ground parallel inductor element may be formed to connect the conductor cover to at least one ground part.

According to another aspect of the present invention, there is provided a metamaterial antenna including a conductor cover, a feed parallel inductor element, a first ground parallel inductor element, and a second ground parallel inductor element. The conductor cover may be formed at one side of a wireless terminal. The feed parallel inductor element may be formed to connect one end of the conductor cover to a feed part. The first ground parallel inductor element may be formed to connect the other end of the conductor cover to a first ground part. The second ground parallel inductor element may be formed to connect the conductor cover to a second ground part between both ends of the conductor cover.

According to another aspect of the present invention, there is provided a metamaterial antenna including a conductor cover, a plurality of couple patches, a feed parallel inductor element, and at least one ground parallel inductor element. The conductor cover may be formed at one side of a wireless terminal. The plurality of couple patches may be formed to be spaced at a predetermined interval from the conductor cover. The feed parallel inductor element may be formed to connect one of the plurality of couple patches to a feed part. The at least one ground parallel inductor element may be formed to connect the remaining couple patches of the plurality of couple patches to a ground part.

According to another aspect of the present invention, there is provided a metamaterial antenna including a conductor cover, a couple patch, a feed parallel inductor element, and at least one ground parallel inductor element. The conductor cover may be formed at one side of a wireless terminal. The couple patch may be formed to be spaced at a predetermined interval from the conductor cover. The feed parallel inductor element may be formed to connect the couple patch to a feed part. The at least one ground parallel inductor element may be formed to connect the couple patch to a ground part.

According to the above-described aspects of the present invention, the radiation efficiency of an embedded antennal formed on a main board of a wireless terminal can be prevented from being degraded while maintaining the design of the wireless terminal provided by a conductor cover, using the conductor cover formed at the exterior of the wireless terminal as an antenna. In addition, since an antenna is additionally formed without using a separate space in the wireless terminal, multiple antennas can be implemented while maximizing the spatial use of the wireless terminal.

In addition, as the conductor cover serves as an antenna using the Epsilon Negative (ENG) construction, a resonant frequency and an input impedance of the metamaterial antenna can be easily adjusted through at least one of inductance values and positions of parallel inductor elements.

In addition, as the conductor cover is not directly connected to the main board of the wireless terminal, the main board of the wireless terminal is prevented from being damaged by an external surge signal.

DETAILED DESCRIPTION

Hereinafter, detailed embodiments of metamaterial antennas according to the present invention will be described with reference to FIGS. 1 to 17. However, the exemplary embodiments of the invention are merely illustrative examples and the present invention is not limited thereto.

In describing the present invention, detailed descriptions that are well-known but are likely to make the subject matter of the present invention unclear will be omitted in order to avoid redundancy. The terminology used herein is defined in consideration of its function in the present invention, and may vary with an intention of a user and an operator or custom. Accordingly, the definition of the terms should be determined based on overall contents of the specification.

These inventive concepts are determined by scope of claims, and it would be appreciated by those skilled in the art that changes and modifications, which have not been illustrated above, may be made in these embodiments without departing from the principles and scope of the invention, the scope of which is defined in the claims and their equivalents.

Figure 1:
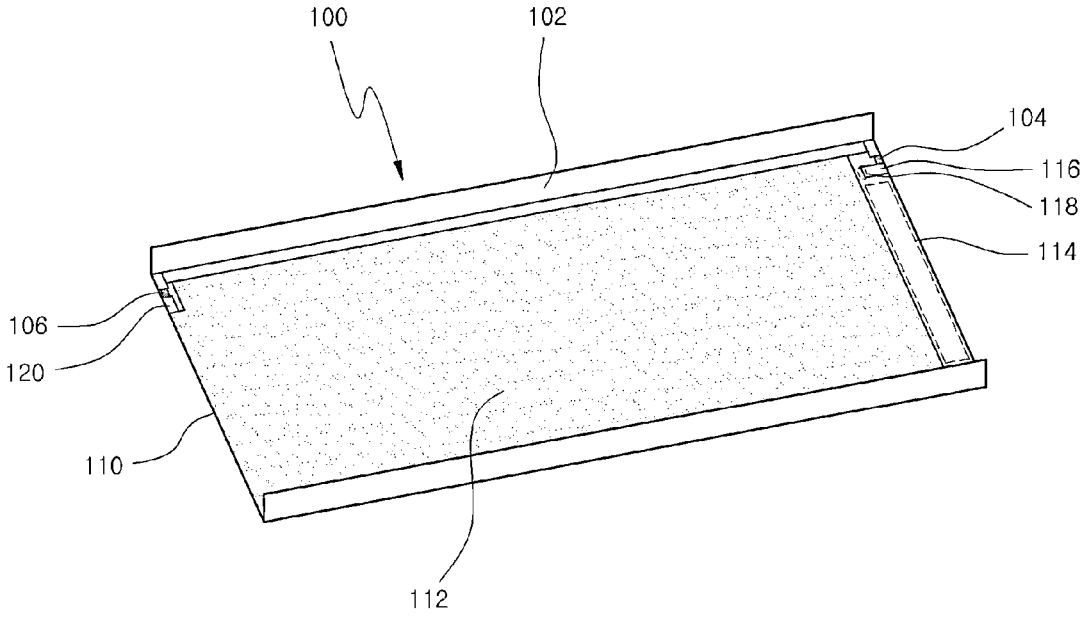
FIG. 1 is a view illustrating a metamaterial antenna in accordance with a first embodiment of the present invention.

FIG. 1 is a view illustrating a metamaterial antenna in accordance with a first embodiment of the present invention.

Referring to FIG. 1, a metamaterial antenna 100 includes a conductor cover 102, a feed parallel inductor element 104, and a ground parallel inductor element 106. The metamaterial antenna 100 exhibits metamaterial properties through the feed parallel inductor element 104 and the ground parallel inductor element 106, and details thereof will be described later.

The conductor cover 102, for example, may be formed at a lateral side of a wireless terminal (not shown) with a predetermined length. In this case, the conductor cover 102 may be formed at one side or both sides of the wireless terminal (not shown). Both ends of the conductor cover 102 are fixed to a main board 110 of the wireless terminal. A ground 112 having a predetermined area is formed on the main board 110 of the wireless terminal, and on a region of the main board 110 where the ground 112 is not formed, an embedded antenna 114 is provided separately from the metamaterial antenna 100. For convenience of description, the embedded antenna 114 is represented by a dotted line. For convenience of description, although the following description will be made only in relation to a conductor cover 102 formed at a left side of the wireless terminal (not shown), a metamaterial antenna may be implemented in the same manner using a conductor cover formed at a right side of the wireless terminal (not shown), and a metamaterial antenna may be implemented using at least one of conductor covers formed at both sides of the wireless terminal (not shown). Although the conductor cover 102 is illustrated as being formed at a lateral side of the wireless terminal (not shown), the present invention is not limited thereto. For example, the conductor cover 102 may be formed at any of a front side, a rear side, an upper side, and a lower side of the wireless terminal (not shown).

The feed parallel inductor element 104 is formed to connect one end of the conductor cover 102 to one end of a feed part 116. The other end of the feed part 116 is spaced at a predetermined interval from the ground 112. A feeding point 118 is formed at the other end of the feed part 116.

The ground parallel inductor element 106 is formed to connect the other end of the conductor cover 102 to one end of a ground part 120. In this case, the other end of the ground part 120 is connected to the ground 112.

As described above, one end of the conductor cover 102 is connected to the feed part 116 through the feed parallel inductor element 104, and the other end of the conductor cover 102 is connected to the ground part 120 through the ground parallel inductor element 106, thereby using the conductor cover 102 as an antenna. Accordingly, radiation efficiency of the internal antenna 114 may be prevented from being degraded.

In general, when a conductor material is present around an antenna, the conductor material confines or restrains electric waves radiated from the antenna so as to limit an electrical volume of the antenna, thereby degrading the radiation characteristics of the antenna. As such, the conventional conductor cover is a simple conductor material, and causes the radiation characteristics of the embedded antenna 114 to be degraded.

Meanwhile, the conductor cover 102 in accordance with embodiments of the present invention serves as an antenna rather than a simple conductor material. In this case, it is possible to enhance the radiation efficiency of the embedded antenna 114 that may be degraded due to the conventional conductor cover. In this case, when a resonant frequency of the conductor cover 102 is adjusted to be same as a resonant frequency of the embedded antenna 114, improved radiation efficiency is provided compared to when only the embedded antenna 114 is used. Meanwhile, the embedded antenna 114 is provided at a front end portion or a rear end portion of the main board 110, and the conductor cover 102 is formed at a side of the main board 110. Here, since the two antennas are provided perpendicular to each other, mutual interference hardly occurs between the internal antenna 114 and the conductor cover 102.

Since the conductor cover 102 is designed in views of the design, and fixedly formed at the wireless terminal (not shown), it is not easy to change the structure of the conductor cover 102 in terms of resonance frequency adjustment and impedance matching. According to embodiments of the present invention, it is possible to use the conductor cover 102 as an antenna using a construction of Epsion Negative (ENG), which is a type of a metamaterial, without changing the structure of the conductor cover 102.

Metamaterials are materials or electromagnetic structures artificially engineered to have electromagnetic properties that have not yet been found in nature, and having at least one of permittivity and permeability provided in a negative value. The metamaterial antenna 100 in accordance with embodiments of the present invention has negative permittivity due to the feed parallel inductor element 104 and the ground parallel inductor element 106, thereby exhibiting metamaterial properties. Since electromagnetic waves propagated through the metamaterial has a negative phase velocity and a negative group velocity opposite to the propagation direction of the electromagnetic waves, the electromagnetic waves are propagated by following a Fleming's left-hand rule rather than following a Fleming's right-hand rule, exhibiting a left-handed property. Accordingly, the metamaterial antenna 100 has a zero-order resonance or a negative order resonance, so that a resonant frequency may be determined regardless of the antenna length.

That is, the resonant frequency of the metamaterial antenna 100 is determined by inductance values of the feed parallel inductor element 104 and the ground parallel inductor element 106. Accordingly, in the resonant frequency matching and the impedance matching, there is no need to change the structure of the conductor cover 102, and only the inductance values of the feed parallel inductor element 104 and the ground parallel inductor element 106 need to be adjusted. In detail, the resonant frequency and the input impedance of the metamaterial antenna 100 are adjusted by ratios of the inductances of the feed parallel inductor element 104 and the ground parallel inductor element 106. As such, by using the ENG construction, the conductor cover 102 is easily used as an antenna.

According to embodiments of the present invention, the conductor cover 102 is used as an antenna, so that the radiation efficiency of the internal antenna 114 formed on the main board 110 of the wireless terminal is prevented from being degraded while maintaining the design of the wireless terminal provided by the conductor cover 102. In addition, an antenna is additionally formed without using a separate space of the wireless terminal, so that multiple antennas are implemented while maximizing the spatial use of the wireless terminal.

Figure 2:
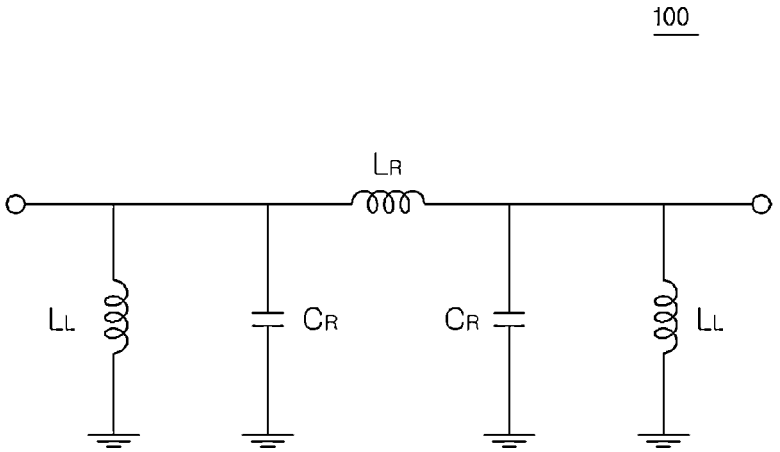
FIG. 2 is a view illustrating an equivalent circuit of the metamaterial antenna in accordance with the first embodiment of the present invention.

FIG. 2 is a view illustrating an equivalent circuit of the metamaterial antenna in accordance with the first embodiment of the present invention.

Referring to FIG. 2, the metamaterial antenna 100 includes series inductances $L_R$, parallel capacitances $C_R$, and parallel inductances $L_L$. The series inductance $L_R$ represents an inductance component according to a length of the conductor cover 102, the parallel capacitance $C_R$ represents a capacitance component according to an interval between the conductor cover 102 and the ground 112, and the parallel inductances $L_L$ represent inductance components according to the feed parallel inductor element 104 and the ground parallel inductor element 106.

The metamaterial antenna 10 has a Right-Handed (RH) property due to the series inductance $L_R$ and the parallel capacitances $C_R$, and has a left-Handed (LH) property due to the parallel inductances $L_L$. The metamaterial antenna 100 has the above-described metamaterial property due to the parallel inductances $L_L$, so that the resonant frequency and the input impedance may be adjusted by inductance values of the parallel inductances $L_L$ without changing the structure of the conductor cover 102.

Meanwhile, although the conductor cover 102 is illustrated as being connected at both ends thereof to the feed parallel inductor element 104 and the ground parallel inductor element 106, the positions on the conductor cover 102 at which the feed parallel inductor element 104 and the ground parallel inductor element 106 are connected are not limited thereto, and may be variously provided.

Figure 3:
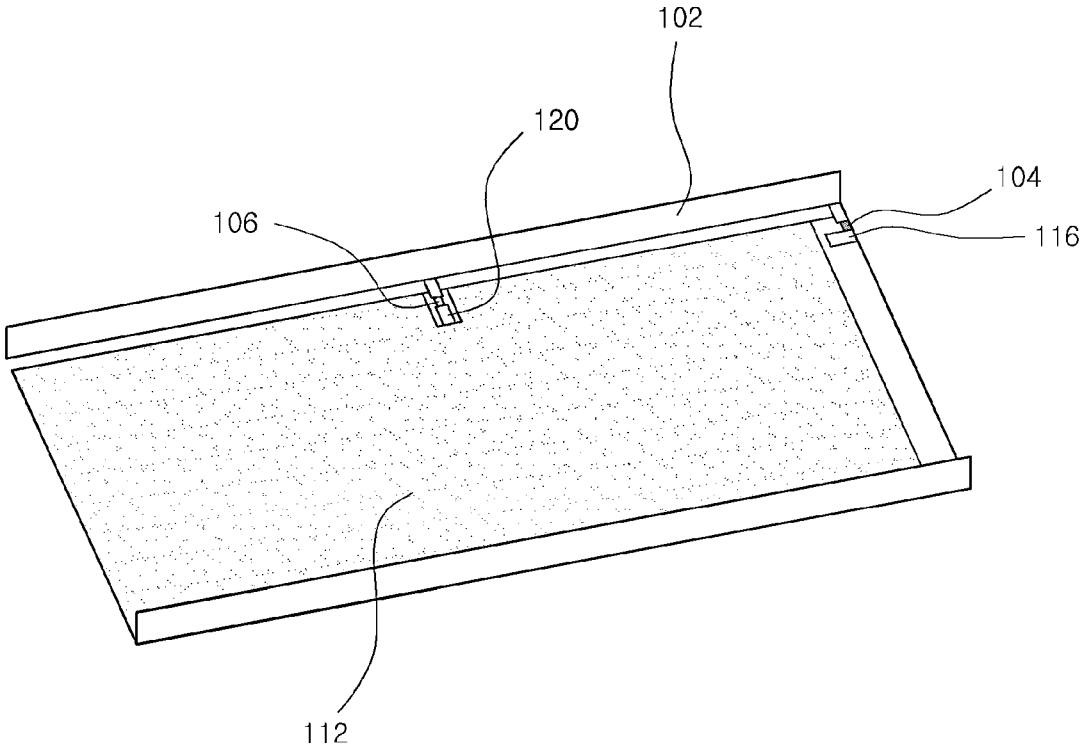
FIG. 3 is a view illustrating a metamaterial antenna in accordance with a second embodiment of the present invention.

For example, referring to FIG. 3, the feed parallel inductor element 104 may be connected to one end of the conductor cover 102, and the ground parallel inductor element 106 may be connected to a middle portion of the conductor cover 102. In this case, the resonant frequency and the input impedance may be adjusted by the positions on the conductor cover 102 at which the feed parallel inductor element 104 and the ground parallel inductor element 106.

That is, the resonant frequency and the input impedance may be adjusted not only by inductance values of the feed parallel inductor element 104 and the ground parallel inductor element 106 but also by the positions on the conductor cover 102 at which the feed parallel inductor element 104 and the ground parallel inductor element 106. Details thereof will be described with reference to FIGS. 4 and 5.

Figure 4:
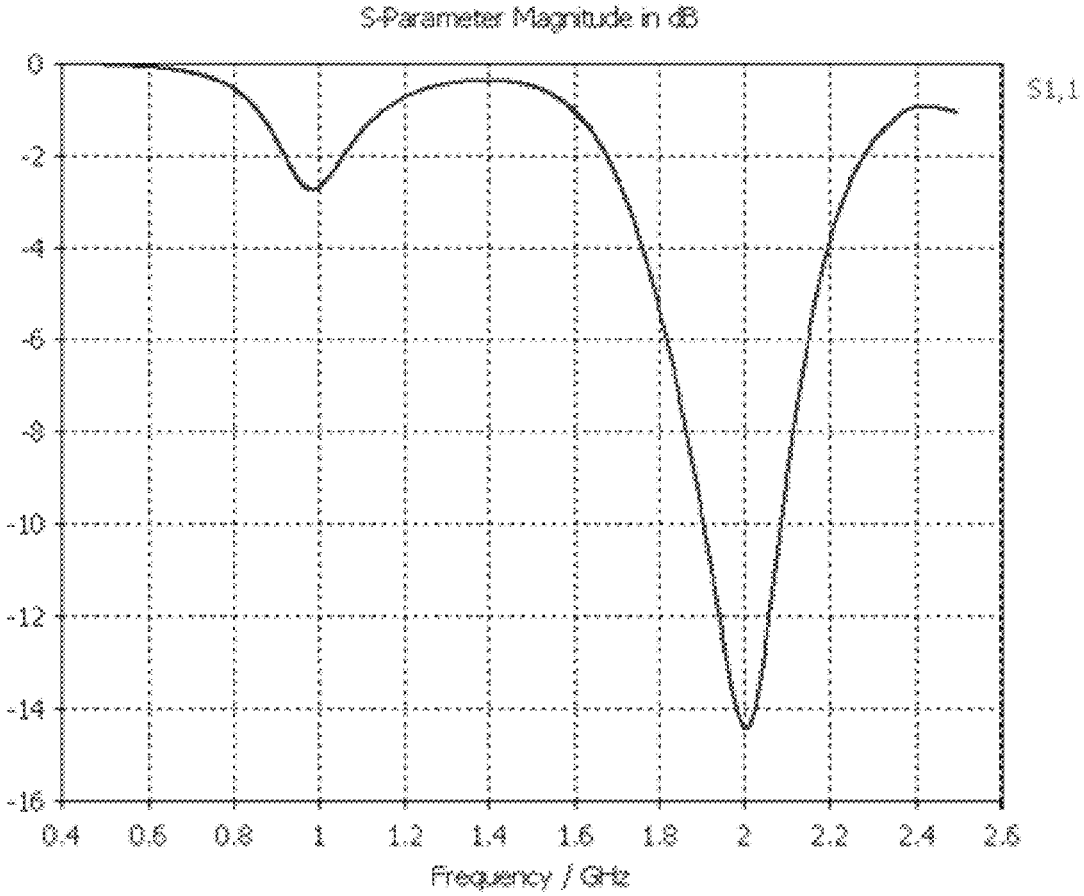
FIG. 4 is a graph showing a reflection coefficient of the metamaterial antenna in accordance with the first embodiment of the present invention shown in FIG. 1.
Figure 5:
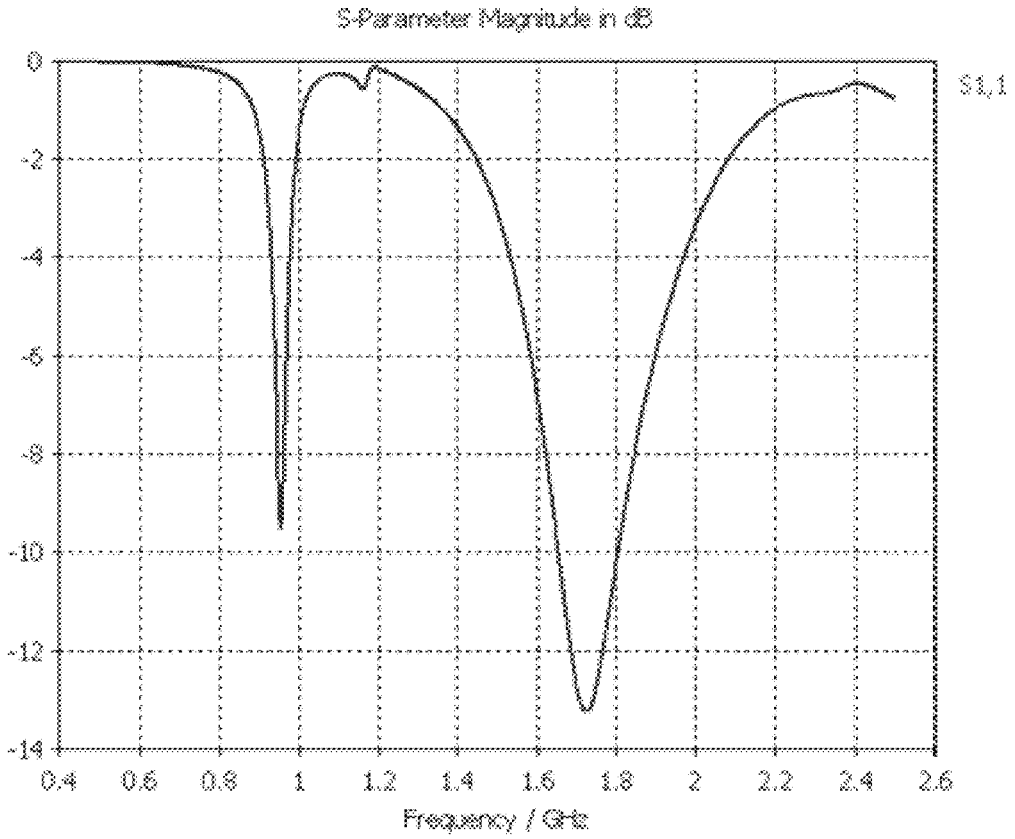
FIG. 5 is a graph showing a reflection coefficient of the metamaterial antenna in accordance with the second embodiment of the present invention shown in FIG. 3.

FIG. 4 is a graph showing a reflection coefficient of the metamaterial antenna in accordance with the first embodiment of the present invention shown in FIG. 1, and FIG. 5 is a graph showing a reflection coefficient of the metamaterial antenna in accordance with the second embodiment of the present invention shown in FIG. 3.

Referring to FIG. 4, when the feed parallel inductor element 104 and the ground parallel inductor element 106 are connected to both ends of the conductor cover 102, the metamaterial antenna 100 has reflection coefficients of −3 dB and −14 dB at 1 GHz and 2 GHz. The reflection coefficient at 1 GHz is too great for the metamaterial antenna 100 to serve as an antenna. The reason why a reflection coefficient is great at 1 GHz is that impedance matching is poor due to a large length of the conductor cover 102.

Meanwhile, referring to FIG. 5, when the feed parallel inductor element 104 is connected to one end of the conductor cover 102, and the ground parallel inductor element 106 is connected to a middle portion of the conductor cover 102, the metamaterial antenna 100 has reflection coefficients of −9.5 dB and −13 dB at 950 MHz and 1.7 GHz.

The resonant frequencies are adjusted from 1 GHz and 2 GHz to 950 MHz and 1.7 GHz, and at 950 MHz, improved impedance matching is shown compared to FIG. 4. As such, the resonant frequency and the input impedance by changing the connection position of the ground parallel inductor element 106.

According to the embodiment of the present invention, by allowing the conductor cover to serve as an antenna using the ENG construction, the resonant frequency and the input impedance of the metamaterial antenna are easily adjusted through one of inductance values of the parallel inductor elements and the positions of the parallel inductor elements.

Although the metamaterial antennas according to the first embodiment and the second embodiment each are illustrated as being formed of a single unit cell, the present invention is not limited thereto. A metamaterial antenna according to another embodiment of the present invention may be formed of a plurality of unit cells. The following description will be made in relation to a metamaterial antenna formed of a plurality of unit cells.

Figure 6:
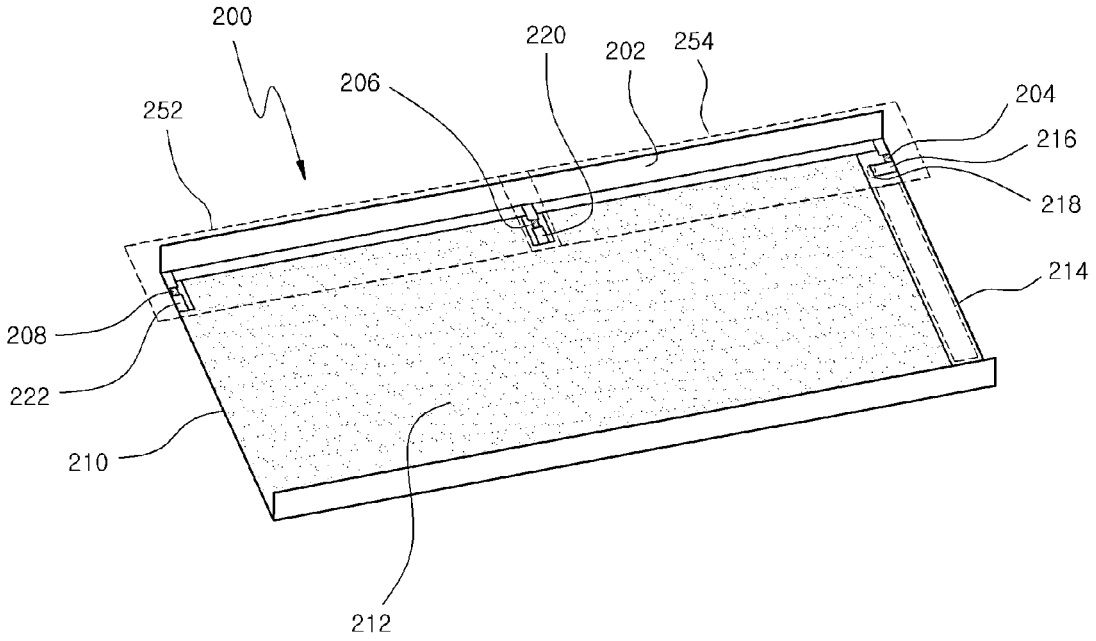
FIG. 6 is a view illustrating a metamaterial antenna in accordance with a third embodiment of the present invention.

FIG. 6 is a view illustrating a metamaterial antenna in accordance with a third embodiment of the present invention.

Referring to FIG. 6, a metamaterial antenna 200 includes a conductor cover 202, a feed parallel inductor element 204, a first ground parallel inductor element 206, and a second ground parallel inductor element 208.

The feed parallel inductor element 204 is formed to connect one end of the conductor cover 202 to one end of a feed part 216. The other end of the feed part 216 is spaced at a predetermined interval from a ground 212. A feeding point 218 is formed at the other end of the feed part 216.

The first ground parallel inductor element 206 is formed to connect a middle portion of the conductor cover 202 to one end of a first ground part 220. The other end of the first ground part 220 is connected to the ground 212. Although the first ground parallel inductor element 206 is illustrated as being connected at a middle portion of the conductor cover 202, the position at which the first ground parallel inductor element 206 is formed is not limited thereto as long as the first ground parallel inductor element 206 is connected to the conductor cover 202 between both ends of the conductor cover 202.

The second ground parallel inductor element 208 is formed to connect the other end of the conductor cover 202 to one end of a second ground part 222. The other end of the second ground part 222 is connected to the ground 212.

The metamaterial antenna 200 includes a first unit cell 252 and a second unit cell 254. That is, the first unit cell 252 is formed to include the ground 212, the second ground part 222, the second ground parallel inductor element 208, a portion between the other end of the conductor cover 202 and the middle portion of the conductor cover 202, the first ground parallel inductor element 206, and the first ground part 220, and the second unit cell 254 is formed by the ground 212, the first ground part 222, the first ground parallel inductor element 206, a portion between the middle portion of the conductor cover 202 to the one end of the conductor cover 202, the feed parallel inductor element 204, and the feed part 216.

Although the metamaterial antenna 200 is illustrated as being formed of two unit cells 252 and 254, the present invention is not limited thereto. A metamaterial antenna according to another embodiment of the present invention may include two or more unit cells. The following description will be made in relation that a metamaterial may be formed of two or more unit cells. For example, the metamaterial antenna 200 may be formed of a larger number of unit cells to additionally connect one end of a ground parallel inductor element to the conductor cover 202 between both ends of the conductor cover 202. In this case, the other end of the added ground parallel inductor element is connected to the ground through a ground part.

When the metamaterial antenna 200 is formed of a plurality of unit cells as described above, the input impedance of the metamaterial antenna 200 is changed, thereby the input impedance of the metamaterial antenna 200 is adjusted. In detail, the more unit cells of the metamaterial antenna 200 are, the higher input impedance of the metamaterial antenna 200 is. Accordingly, when the impedance matching is poorly achieved due to a low input impedance of the metamaterial antenna 200, the number of unit cells of the metamaterial antenna 200 is increased so as to increase the input impedance, thereby smoothly achieving the impedance matching.

Figure 7:
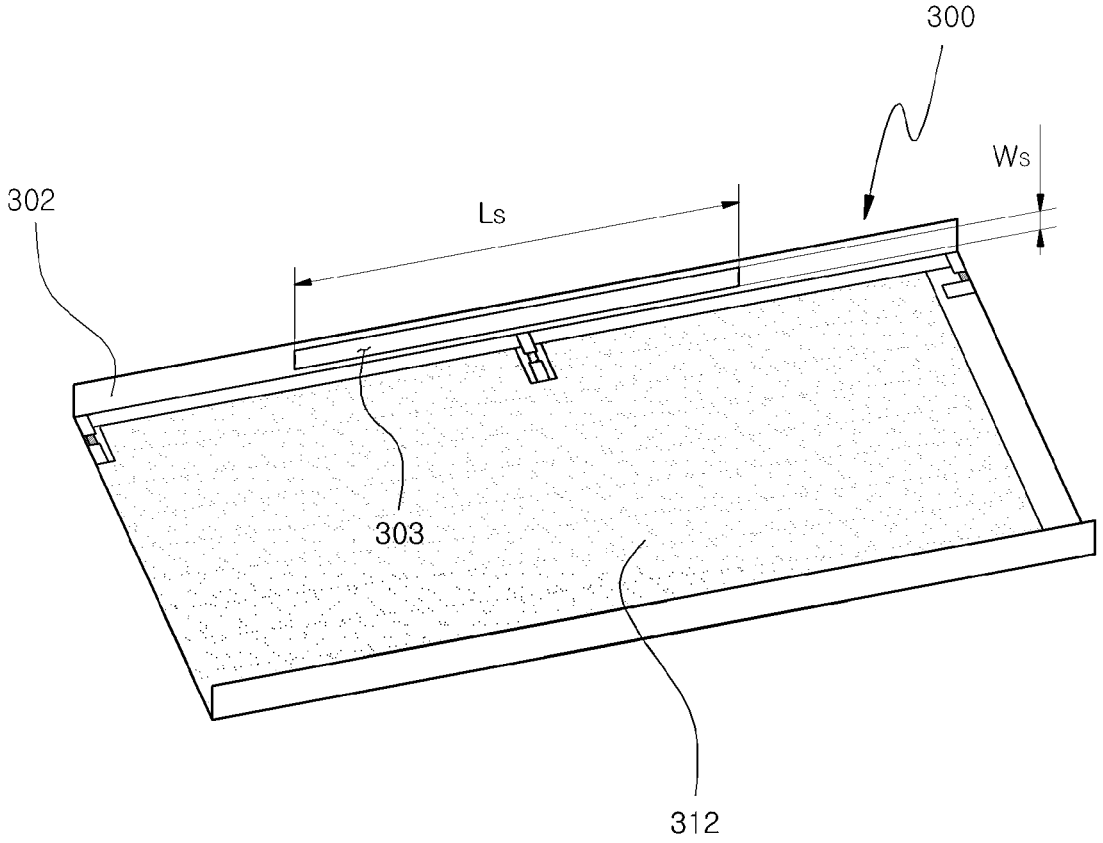
FIG. 7 is a view illustrating a metamaterial antenna in accordance with a fourth embodiment of the present invention.

FIG. 7 is a view illustrating a metamaterial antenna in accordance with a fourth embodiment of the present invention, which is identical to the description of FIG. 6 except that a conductor cover 302 is provided with a slot 303 having a predetermined length Ls and a predetermined width Ws.

In a general antenna, a slot is used to generate another resonant frequency so that the frequency bandwidth is expanded or multiple frequency bands are implemented. However, when the slot 303 is formed at the conductor cover 302, a capacitance value of the parallel capacitance $C_R$ is changed according to an interval between the conductor cover 302 and a ground 312, which causes the resonant frequency and the input impedance of the metamaterial antenna 300 to be changed. That is, the capacitance value of the parallel capacitance $C_R$ is changed according to the width Ws and the length Ls of the slot 303, so that the resonant frequency and the input impedance of the metamaterial antenna 300 are changed.

Figure 8:
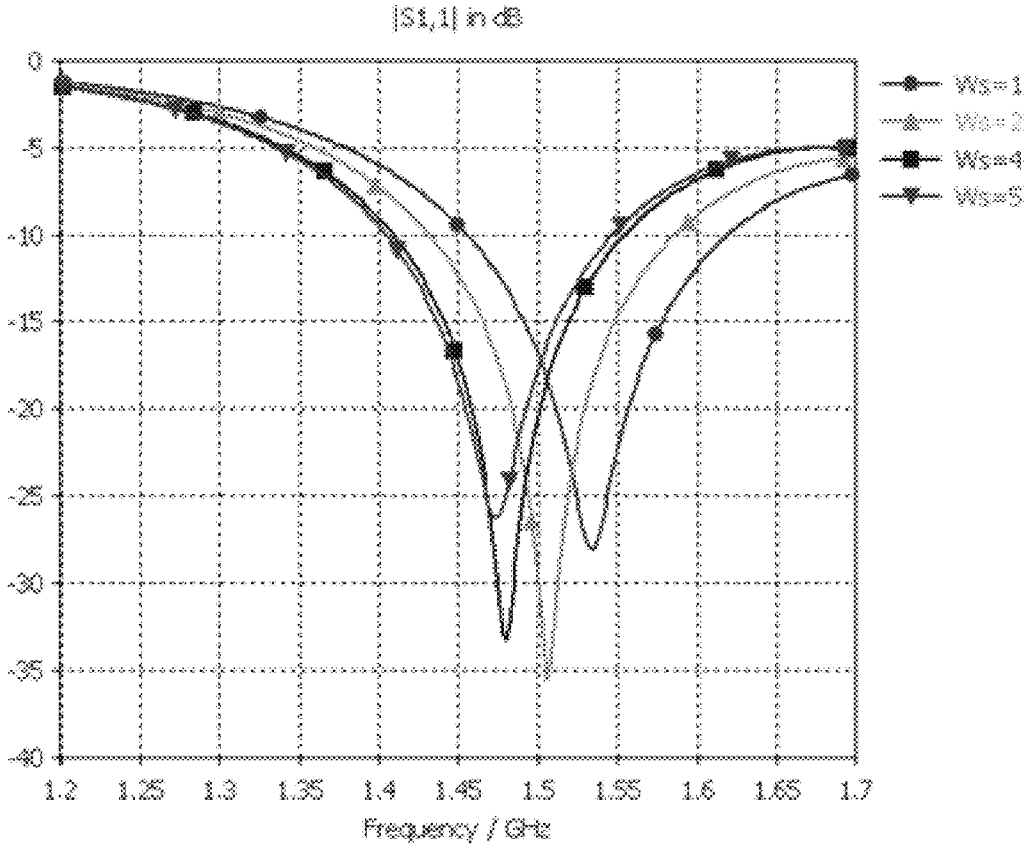
FIG. 8 is a graph showing a change in a resonant frequency according to a width of a slot in the metamaterial antenna in accordance with the fourth embodiment of the present invention.

FIG. 8 is a graph showing a change in a resonant frequency according to a width of a slot in the metamaterial antenna in accordance with the fourth embodiment of the present invention, which shows a change in resonant frequency when the width Ws of the slot 303 is increased 1 mm at a time from 1 mm to 5 mm.

Figure 9:
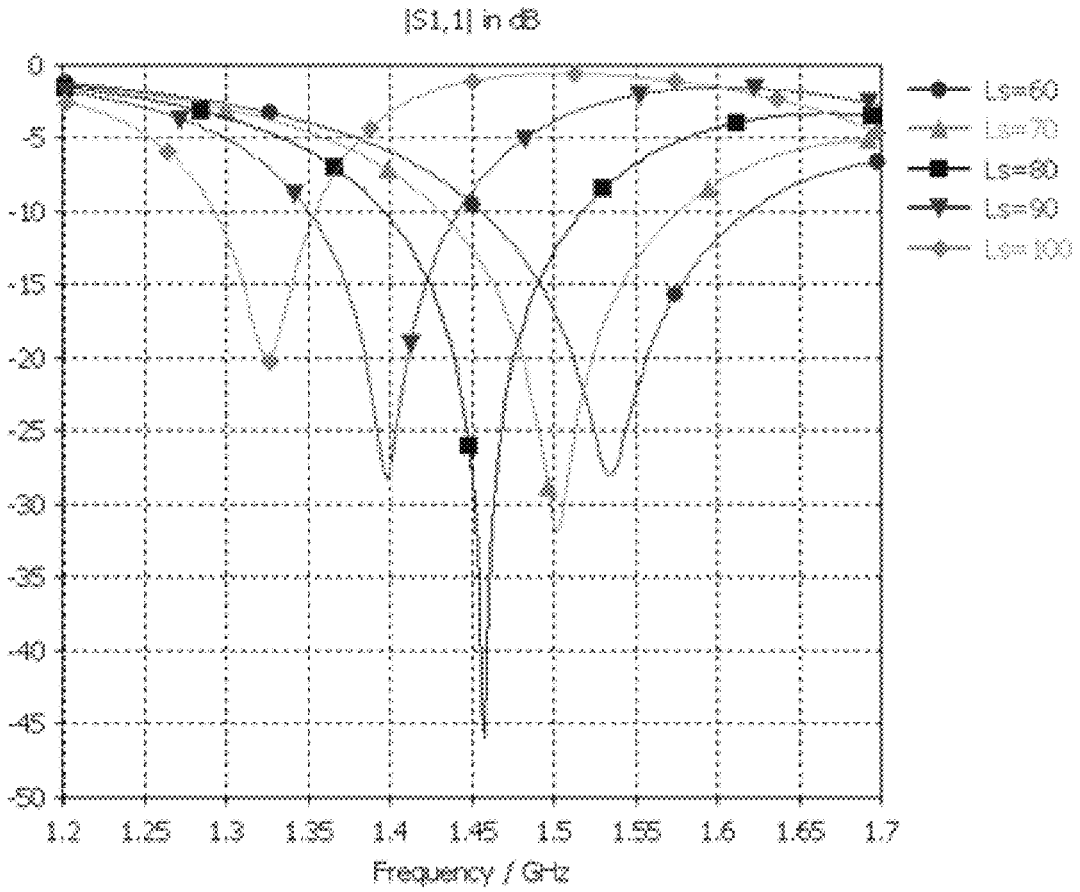
FIG. 9 is a graph showing a change in resonant frequency according to a length of a slot in the metamaterial antenna in accordance with a fourth embodiment of the present invention.

FIG. 9 is a graph showing a change in a resonant frequency according to a length of a slot in the metamaterial antenna in accordance with a fourth embodiment of the present invention, which shows a change in resonant frequency when the length Ls of the slot 303 is increased 10 mm at a time from 60 mm to 100 mm.

As the resonant frequency and the input impedance of the metamaterial antenna 300 are changed by the length Ws and the length Ls of the slot 303, the resonant frequency and the input impedance of the metamaterial antenna 300 may be adjusted by changing the inductance value of each parallel inductor element.

Figure 10:
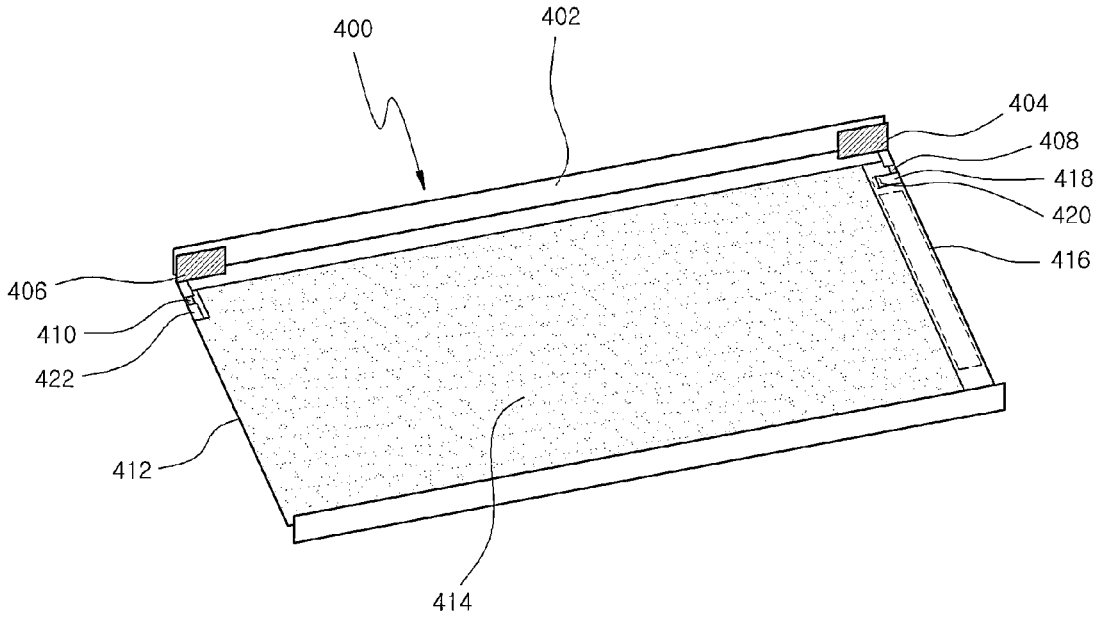
FIG. 10 is a perspective view illustrating a metamaterial antenna in accordance with the fifth embodiment of the present invention.
Figure 11:
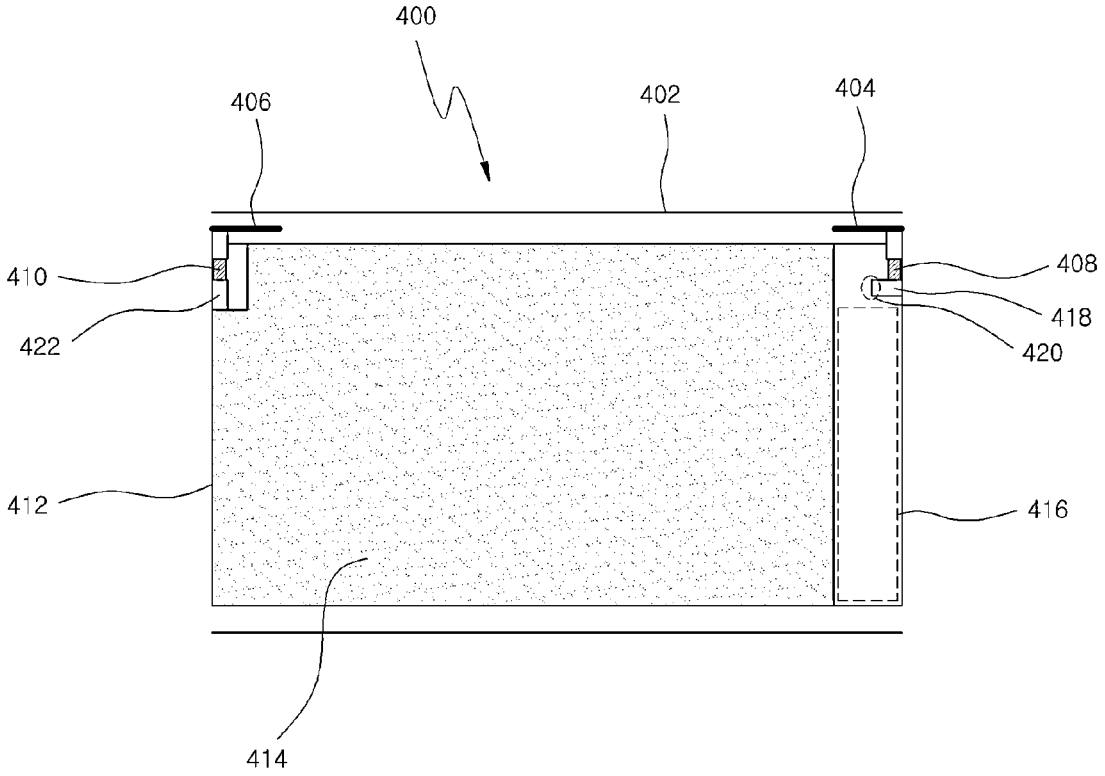
FIG. 11 is a plan view illustrating the metamaterial antenna in accordance with the fifth embodiment of the present invention.

FIG. 10 is a perspective view illustrating a metamaterial antenna in accordance with the fifth embodiment of the present invention, and FIG. 11 is a plan view illustrating the metamaterial antenna in accordance with the fifth embodiment of the present invention.

Referring to FIGS. 10 and 11, a metamaterial antenna 400 includes a conductor cover 402, a first couple patch 404, a second couple patch 406, a feed parallel inductor element 408, and a ground parallel inductor element 410. The metamaterial antenna 400 exhibits metamaterial properties through the feed parallel inductor element 408 and the ground parallel inductor element 410. Details thereof will be made described later.

The conductor cover 402, for example, may be fixedly provided at a lateral side of a wireless terminal (not shown) with a predetermined length. The conductor cover 102 may be formed at one side of the wireless terminal (not shown) or both sides of the wireless terminal (not shown). For convenience sake, the following description will be made in relation to the conductor cover 402 formed at a left side of the wireless terminal (not shown), but a metamaterial antenna may be implemented in the same manner by using a conductor cover formed at a right side of the wireless terminal (not shown), and may be implemented using at least one of the conductor covers formed at both sides of the wireless terminal (not shown). Although the conductor cover 402 is illustrated as being formed at a lateral side of the wireless terminal (not shown), the present invention is not limited thereto. For example, the conductor cover 402 may be formed on any of a front side, a rear side, an upper side and a lower side.

The first couple patch 404 is fixed to one end of a side of a main board 412 of the wireless terminal. The first couple patch 404 is spaced apart from one end of the conductor cover 402. For example, the first couple patch 404 may be formed in parallel with the conductor cover 402 while being spaced at a predetermined interval from one end of the conductor cover 402.

Meanwhile, a ground 414 having a predetermined area is formed on the main board 412 of the wireless terminal, and on a region of the main board 412 where the ground 414 is not formed, an internal antenna 416 is provided separately from the metamaterial antenna 400. For convenience of description, the internal antenna 416 is represented by a dotted line.

The second couple patch 406 is fixed to the other end of the side of the main board 412 of the wireless terminal. The second couple patch 406 is spaced apart from the other end of the conductor cover 402. For example, the second couple patch 406 may be formed in parallel with the conductor cover 402 while being spaced at a predetermined interval from the other end of the conductor cover 402.

The feed parallel inductor element 408 is formed to connect the first couple patch 404 to one end of a feed part 418. The other end of the feed part 418 is spaced at a predetermined interval from the ground 414. A feeding point 420 is formed at the other end of the feed part 418.

The ground parallel inductor element 410 is formed to connect the second couple patch 406 to one end of the ground part 422. The other end of the ground part 422 is connected to the ground 414.

In this case, the one end of the conductor cover 402 is spaced at a predetermined interval from the first couple patch 404 connected to the feed part 418, and the other end of the conductor cover 402 is spaced at a predetermined interval from the second couple patch 406 connected to the ground part 422, so that the conductor cover 402 forms an electromagnetic coupling with the first couple patch 404 and the second couple patch 406, and thus the conductor cover 402 serves as an antenna.

Since the conductor cover 402 is not directly connected to the main board 412 of the wireless terminal, the main board 412 of the wireless terminal is prevented from being damaged by an external surge signal, such as static electricity. That is, the conductor cover 402, which is exposed at a side of the wireless terminal, may come into direct contact with a body of a user in use of the wireless terminal. In this case, an external surge signal, such as static electricity, may be generated at the conductor cover 402, and if the conductor cover 402 is directly connected to the main board 412 of the wireless terminal, a circuit formed on the main board 412 may be damaged by the external surge signal. However, according to the embodiment of the present invention, the conductor cover 402 is not directly connected to the main board 412 of the wireless terminal, so that the main board 412 of the wireless terminal is prevented from being damaged even if an external surge signal is generated.

As described above, the conductor cover 402 is used as an antenna, radiation of the internal antenna 416 formed on the main board 412 of the wireless terminal is prevented from being degraded while maintaining the design of the wireless terminal provided by the conductor cover 401. In addition, since an antenna is additionally formed without using a separate space in the wireless terminal, multiple antennas may be implemented while maximizing the spatial use of the wireless terminal. Since the conductor cover 402 is not directly connected to the main board 412 of the wireless terminal, the main board 412 of the wireless terminal is prevented from being damaged by an external surge signal.

Figure 12:
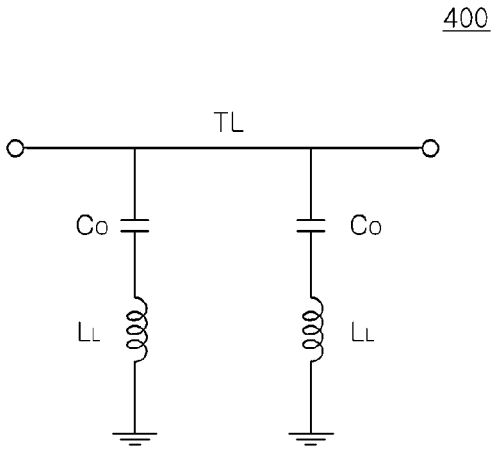
FIG. 12 is a view illustrating an equivalent circuit of the metamaterial antenna in accordance with the fifth embodiment of the present invention.

FIG. 12 is a view illustrating an equivalent circuit of the metamaterial antenna in accordance with the fifth embodiment of the present invention.

Referring to FIG. 12, the metamaterial antenna 400 includes a transmission line TL, additional parallel capacitances $C_0$, and parallel inductances $L_L$. The transmission line TL represents the conductor cover 402, and includes series inductances according to the length of the conductor cover 402 and parallel capacitances according to an interval between the conductor cover 402 and the ground 414. The additional parallel capacitances $C_0$ represent parallel capacitance components according to an interval between the first couple patch 404 and the conductor cover 402 and an interval between the second couple patch 406 and the conductor cover 402, and the parallel inductances $L_L$ represent inductance components according to the feed parallel inductor element 408 and the ground parallel inductor element 410.

The metamaterial antenna 400 has right-hand properties according to the transmission line (TL), that is, the series inductances and the parallel capacitances, and has left-hand properties according to the parallel inductances $L_L$. The metamaterial antenna 100 has the above-described metamaterial properties according to the parallel inductances $L_L$, so that the resonant frequency and the input impedance are adjusted by inductance values of the parallel inductances $L_L$ without changing the structure of the conductor cover 402.

Meanwhile, the metamaterial antenna 400 has the additional parallel capacitances $C_0$ connected to the parallel inductances $L_L$ in series, thereby forming an LC series resonant circuit. Capacitance values of the additional parallel capacitances $C_0$ may be changed according to the sizes of the first couple patch 404 and the second couple patch 406 and the intervals between the first couple patch 404 and the second couple patch 406 and the conductor cover 402. However, the resonant frequency of the metamaterial antenna 400 is not significantly changed even if the capacitance values of the additional parallel capacitances $C_0$ are changed. Therefore, it is proven that the metamaterial antenna 400 is insensitive to changes in the environments according to the first couple patch 404 and the second couple patch 406. Details thereof will be described with reference to FIG. 13.

Figure 13:
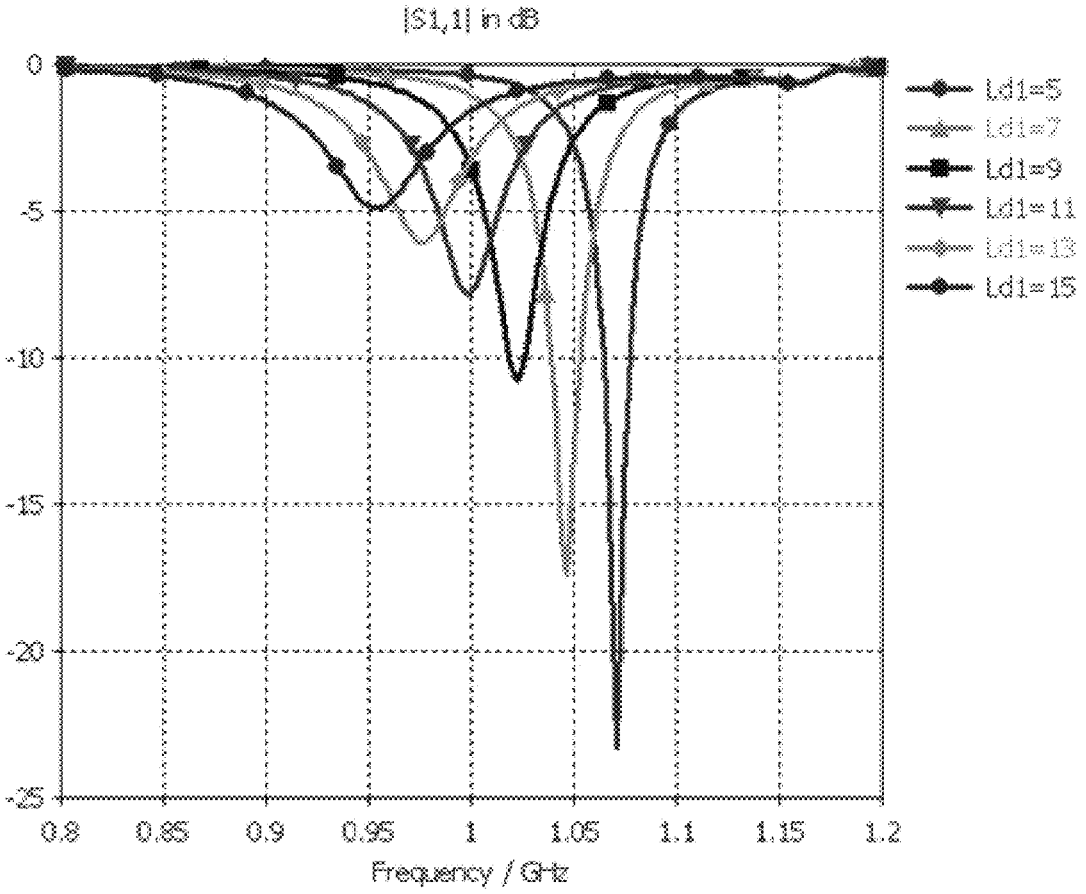
FIG. 13 is a graph showing a change in resonant frequency according to lengths of a first couple patch and a second couple patch of the metamaterial antenna in accordance with the fifth embodiment of the present invention.

FIG. 13 is a graph showing a change in resonant frequency according to lengths of the first couple patch and the second couple patch of the metamaterial antenna in accordance with the fifth embodiment of the present invention.

A change in resonant frequency of the metamaterial antenna 400 is shown when the lengths $L_{d1}$ of the first couple patch 404 and the second couple patch 406 are each increased 2 mm at a time from 5 mm to 15 mm. The following experiment is conducted under the condition that the intervals between the first couple patch 404 and the second couple patch 406 and the conductor cover 402 and the widths of the first couple patch 404 and the second couple patch 406 are not changed. In this case, as the lengths of the first couple patch 404 and the second couple patch 406 are increased, the capacitance values of the additional parallel capacitances $C_0$ are increased, thereby causing the resonant frequency of the metamaterial antenna 400 to be slightly decreased.

Referring to FIG. 13, when the lengths $L_{d1}$ of the first couple patch 404 and the second couple patch 406 are changed from 5 mm to 15 mm, the resonant frequency is changed from 1.075 GHz to 0.95 GHz, which corresponds to 10% change of resonant frequency. Therefore, it is proven that the change in a resonant frequency is not significant when the capacitance values of the additional parallel capacitances $C_0$ are changed, and the metamaterial antenna 400 is insensitive to changes of environments according to the first couple patch 404 and the second couple patch 406.

Although the metamaterial antenna 400 according to the fifth embodiment of the present invention is illustrated as being formed of a single unit cell, the present invention is not limited thereto. For example, a metamaterial antenna according to another embodiment of the present invention may be formed of two or more unit cells.

Figure 14:
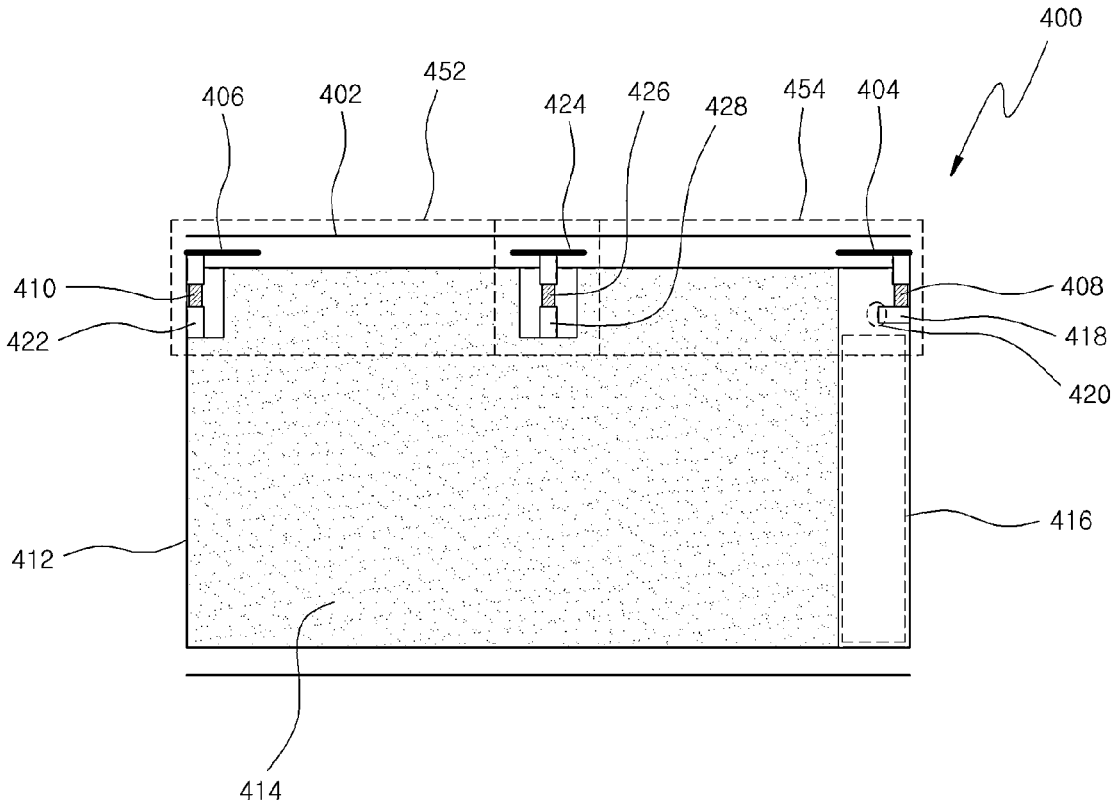
FIG. 14 is a plan view illustrating a metamaterial antenna in accordance with a sixth embodiment of the present invention.

For example, referring to FIG. 14, when a third couple patch 424 is additionally formed at a middle portion of a side of the main board 412 of the wireless terminal, the metamaterial antenna 400 includes two unit cells 452 and 454. In this case, the third couple patch 424 is spaced apart from the conductor cover 402, and is connected to a ground part 428 through a second ground parallel inductor element 426.

Although the metamaterial antenna 400 in FIG. 14 is illustrated as being formed of two unit cells 452 and 454, a metamaterial antenna according to another embodiment may include two or more unit cells.

When the metamaterial antenna 400 is formed of a plurality of unit cells as described above, the input impedance of the metamaterial antenna 400 is changed, thereby the input impedance of the metamaterial antenna 400 is adjusted. In detail, the more unit cells of the metamaterial antenna 400 are, the higher input impedance of the metamaterial antenna 400 is. Accordingly, when the impedance matching is poor due to a low input impedance of the metamaterial antenna 400, the number of unit cells of the metamaterial antenna 400 is increased so as to increase the input impedance, thereby smoothly achieving the impedance matching.

Figure 15:
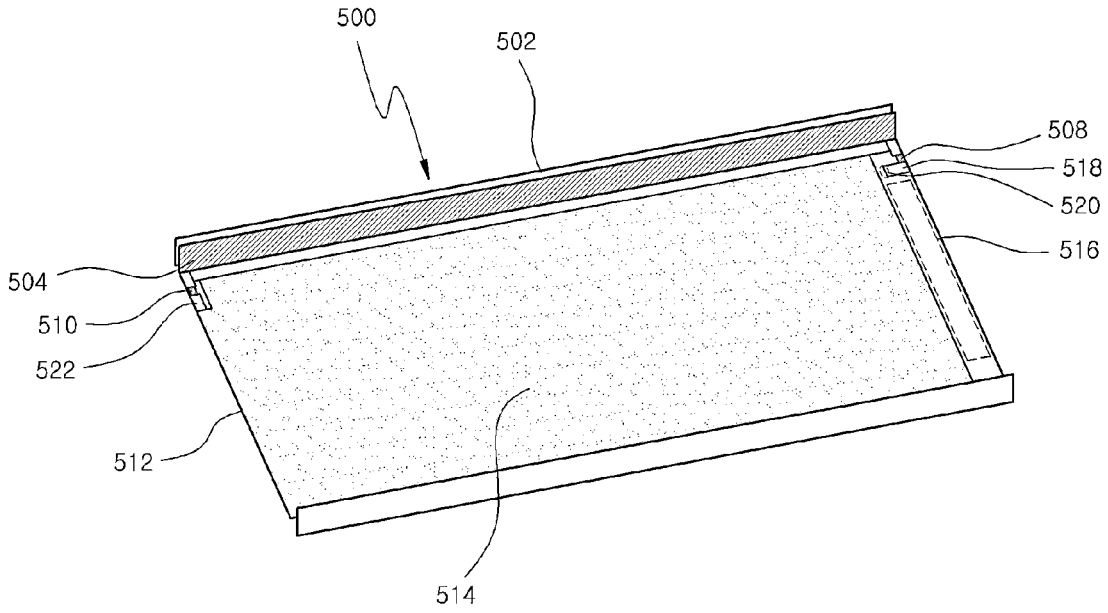
FIG. 15 is a perspective view illustrating a metamaterial antenna in accordance with a seventh embodiment of the present invention.
Figure 16:
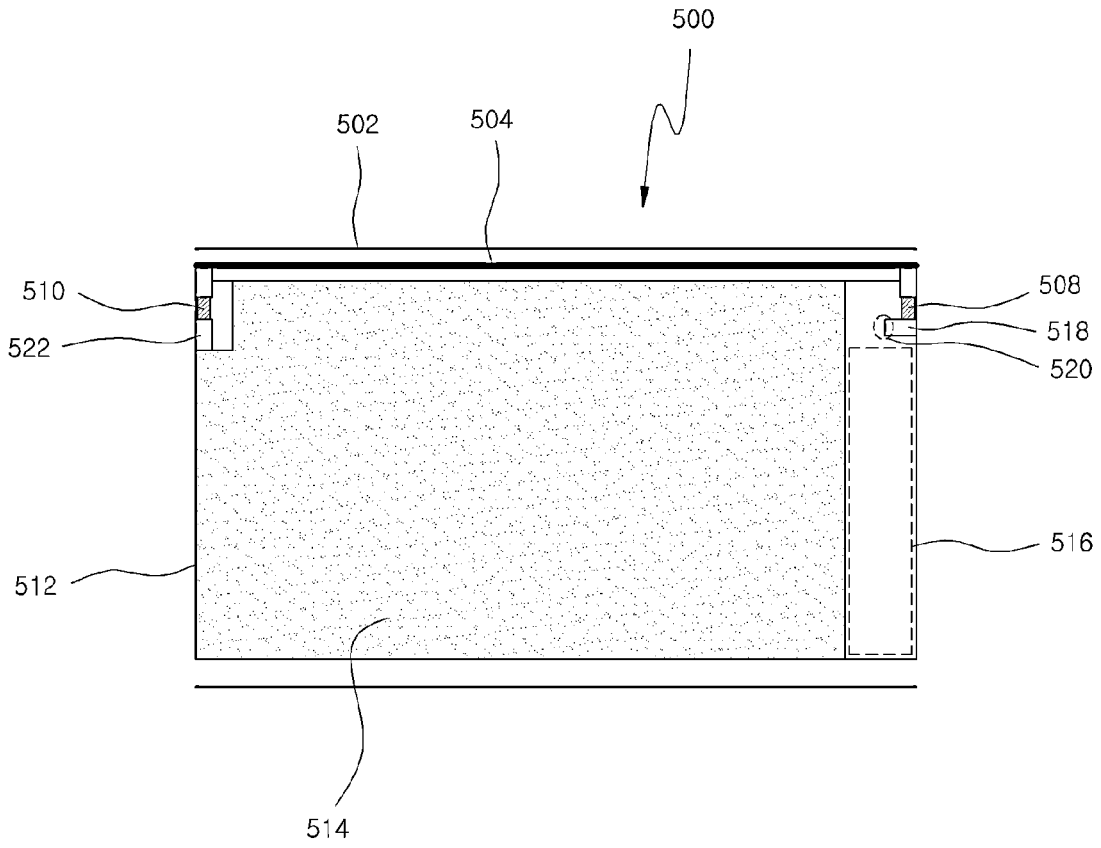
FIG. 16 is a plan view illustrating the metamaterial antenna in accordance with the seventh embodiment of the present invention.

FIG. 15 is a perspective view illustrating a metamaterial antenna in accordance with a seventh embodiment of the present invention, and FIG. 16 is a plan view illustrating the metamaterial antenna in accordance with the seventh embodiment of the present invention.

Referring to FIGS. 15 and 16, a metamaterial antenna 500 includes a conductor cover 502, a couple patch 504, a feed parallel inductor element 508, and a ground parallel inductor element 510.

The couple patch 504 is provided as an integral body, and is spaced apart from the conductor cover 502 at a side of a main board 512 of a wireless terminal. Both ends of the couple patch 504 are fixed to both ends of the side of the main board 512 of the wireless terminal. For example, the couple patch 504 is formed in a parallel manner while being spaced at a predetermined interval from the conductor cover 502.

The feed parallel inductor element 508 is formed to connect one end of the couple patch 504 to one end of a feed part 518. The other end of the feed part 518 is spaced at a predetermined interval from a ground 514. A feeding point 520 is formed at the other end of the feed part 518. The ground parallel inductor element 510 is formed to connect the other end of the couple patch 504 to one end of a ground part 522. The other end of the ground part 522 is connected to the ground 514.

According to the embodiment of the present invention, the conductor cover 502 is electromagnetically coupled with the couple patch 504 to operate as an antenna. In this case, the conductor cover 502 is not directly connected to the main board 512 of the wireless terminal, so that even when an external surge signal is generated, the main board 512 of the wireless terminal is prevented from being damaged.

Meanwhile, although the metamaterial antenna shown in FIGS. 15 and 16 is illustrated as being formed of a single unit cell, the present invention is not limited thereto. A metamaterial antenna according to another embodiment of the present invention may be formed of a plurality of unit cells. For example, the metamaterial antenna 500 may include a plurality of unit cells by additionally forming a ground parallel inductor element to connect the couple patch 504 to the ground between both ends of the couple patch 504.

Figure 17:
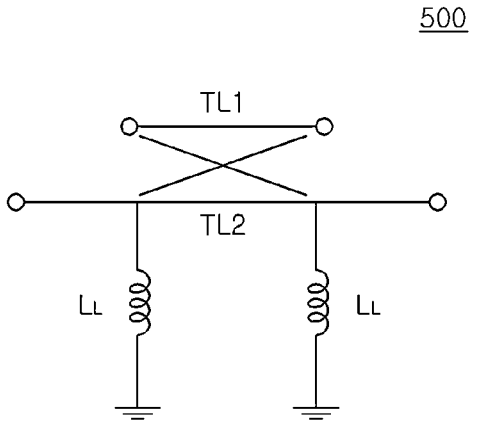
FIG. 17 is a perspective view illustrating an equivalent circuit of the metamaterial antenna in accordance with the seventh embodiment of the present invention.

FIG. 17 is a perspective view illustrating an equivalent circuit of the metamaterial antenna in accordance with the seventh embodiment of the present invention.

Referring to FIG. 17, the metamaterial antenna 500 includes a first transmission line TL1, a second transmission line TL2, and parallel inductances $L_L$. The first transmission line TL1 represents the conductor cover 502, the second transmission line TL2 represents the couple patch 504, and the parallel inductances $L_L$ represent inductance components according to the feed parallel inductor element 508 and the ground parallel inductor element 510. In this case, the first transmission line TL1 is electromagnetically coupled to the second transmission line TL2.

Although a few embodiments of the present invention have been shown and described, it would be appreciated by those skilled in the art that changes may be made in these embodiments without departing from the principles and spirit of the disclosure, the scope of which is defined in the claims and their equivalents.

The invention claimed is:

1. A metamaterial antenna comprising:

a conductor cover to be formed at one side of a wireless terminal;

a first parallel inductor element formed to connect one end of the conductor cover to one end of a feed part; and at least one second parallel inductor element formed to connect the conductor cover to at least one ground part, wherein the other end of the feed part is spaced apart from a ground; and the metamaterial antenna adjusts a resonant frequency by at least one of (i) positions on the conductor cover at which the first parallel inductor element and the second parallel inductor element are connected, and (ii) the number of the second parallel inductor elements.

2. The metamaterial antenna of claim 1, wherein the conductor cover is provided with a slot having a predetermined length and a predetermined width.

* * * * *